United States Patent [19]

McKee et al.

[11] Patent Number: 4,626,811

[45] Date of Patent: Dec. 2, 1986

[54] CIRCUIT INTERRUPTER WITH INTEGRAL RESILIENT STOP MEANS FOR CONTACT ARM

[75] Inventors: Jere L. McKee, Scott Township, Lawrence County; William I. Stephenson, Brighton Township, Beaver County; Donald E. Schlosser, Beaver Falls, all of Pa.

[73] Assignee: Westinghouse Electric Corp., Pittsburgh, Pa.

[21] Appl. No.: 786,987

[22] Filed: Oct. 15, 1985

[51] Int. Cl.[4] ..... H01H 75/00; H01H 77/00; H01H 83/00

[52] U.S. Cl. ..... 335/46; 335/16; 335/195; 335/193; 335/157; 335/104; 335/90; 200/288

[58] Field of Search ..... 335/16, 195, 193, 46, 335/156, 157, 158, 104, 90; 200/288

[56] References Cited

U.S. PATENT DOCUMENTS 4,144,513 3/1979 Shaffer et al. ..... 335/46

4,255,732 3/1981 Wafer et al. ..... 335/193

4,417,223 11/1983 Bancalari ..... 335/195

4,539,538 9/1985 Flick et al. ..... 335/16

*Primary Examiner*—E. A. Goldberg

*Assistant Examiner*—Lincoln D. Donovan

*Attorney, Agent, or Firm*—D. S. Buleza

[57] ABSTRACT

The gap distance separating the contacts of a low-voltage circuit breaker in the tripped position is increased by utilizing resilient stop means which is located at the bottom wall of the breaker housing rather than at the top wall (or on the handle of the breaker) in accordance with prior art practice. The movable contact arm is pivotally mounted and structured to strike the stop means as the contacts are separated and being blown open during short circuit conditions and, after the circuit breaker is tripped, the collapsed toggle assembly of the operating mechanism shifts the movable contact arm away from the stop means and allows the arm to move an additional distance away from the fixed contact and thus increase the gap distance between the opened contacts.

8 Claims, 6 Drawing Figures

CIRCUIT INTERRUPTER WITH INTEGRAL RESILIENT STOP MEANS FOR CONTACT ARM

BACKGROUND OF THE INVENTION

1. Field of the Invention

This invention generally relates to circuit interrupter apparatus and, more particularly, to an improved contact arm stop structure for a molded case circuit breaker of the low-voltage type.

2. Description of the Prior Art

In order to prevent damage to the operating components or housing when the contacts are rapidly blown open during current overload conditions, it is the common practice in the low-voltage molded case circuit breaker art to employ a so-called "dead rubber" stop that is secured to the cover component of the breaker housing (or to the breaker handle) and is so located that it is struck by the rapidly moving contact arm. The resiliency of the stop provides a cushioning effect which dissipates the kinetic energy of the contact arm and arrests its motion in a very effective manner.

While such resilient stops were generally satisfactory from a functional standpoint, they required the use of a relatively large block of rubber and thus increased the material cost of the breaker. They also increased the handle tooling cost when the stop was attached to this part of the breaker. In addition, the location of the prior art stops at the top of the circuit breaker housing inherently restricted the travel distance of the movable contact arm and thus reduced the gap separating the opened contacts when the circuit breaker was tripped. It is, of course, desirable to have a contact gap as large as possible since this permits the arc between the contacts to be rapidly quenched when the breaker is operated.

SUMMARY OF THE INVENTION

The present invention avoids the foregoing manufacturing and operational disadvantages associated with the prior art stop means for the movable contact arm of a circuit breaker by providing the base component of the breaker housing with a rigid abutment or shoulder and covering it with a pad of resilient material (such as rubber) to form a resilient stop means that is located at the bottom wall of the breaker housing. The contact arm which carries the movable contact is constructed and pivotally mounted within the housing in such a manner that the end portion opposite the movable contact swings toward and strikes the pad portion of the stop when the contacts are "blown open" due to a short circuit or current overload condition. In a preferred embodiment, the breaker housing is fabricated from molded plastic and the shoulder means comprises an upstanding panel-like appendage that is formed as an integral part of the base component of the housing. Since the pad of resilient material does not have to absorb all of the kinetic energy of the moving contact arm but merely provides sufficient cushioning action to prevent the panel-like appendage of the breaker case from being cracked or damaged by the impacting end of the metal contact arm, only a small quantity of resilient material is required compared to the amount used in the prior art stop structures.

Since the resilient stop means is located at the bottom of the circuit breaker housing, the contact arm can travel upwardly an additional distance without striking the cover of the circuit breaker. This additional travel distance materially increases the gap between the opened contacts when the circuit breaker is tripped and thus improves the operational characteristics of the breaker.

In the case of a three-pole low-voltage circuit breaker having three pairs of separable contacts, the base component of the breaker housing is constructed to have three separate integral resilient stop structures that are suitably located within the three compartments of the breaker.

BRIEF DESCRIPTION OF THE DRAWINGS

A better understanding of the invention will be obtained from the exemplary embodiment shown in the accompanying drawings, wherein.

DESCRIPTION OF THE PREFERRED EMBODIMENT

While the improved movable contact arm and stop assembly of the present invention can be employed in various kinds of electrical switching and circuit-interrupting apparatus which have a movable contact that is separated and rapidly swung away from another contact when the circuit breaker is actuated, it is particularly adapted for use in conjunction with low voltage circuit breakers of the molded-case type and it has accordingly been so illustrated and will be so described.

Figure 1:
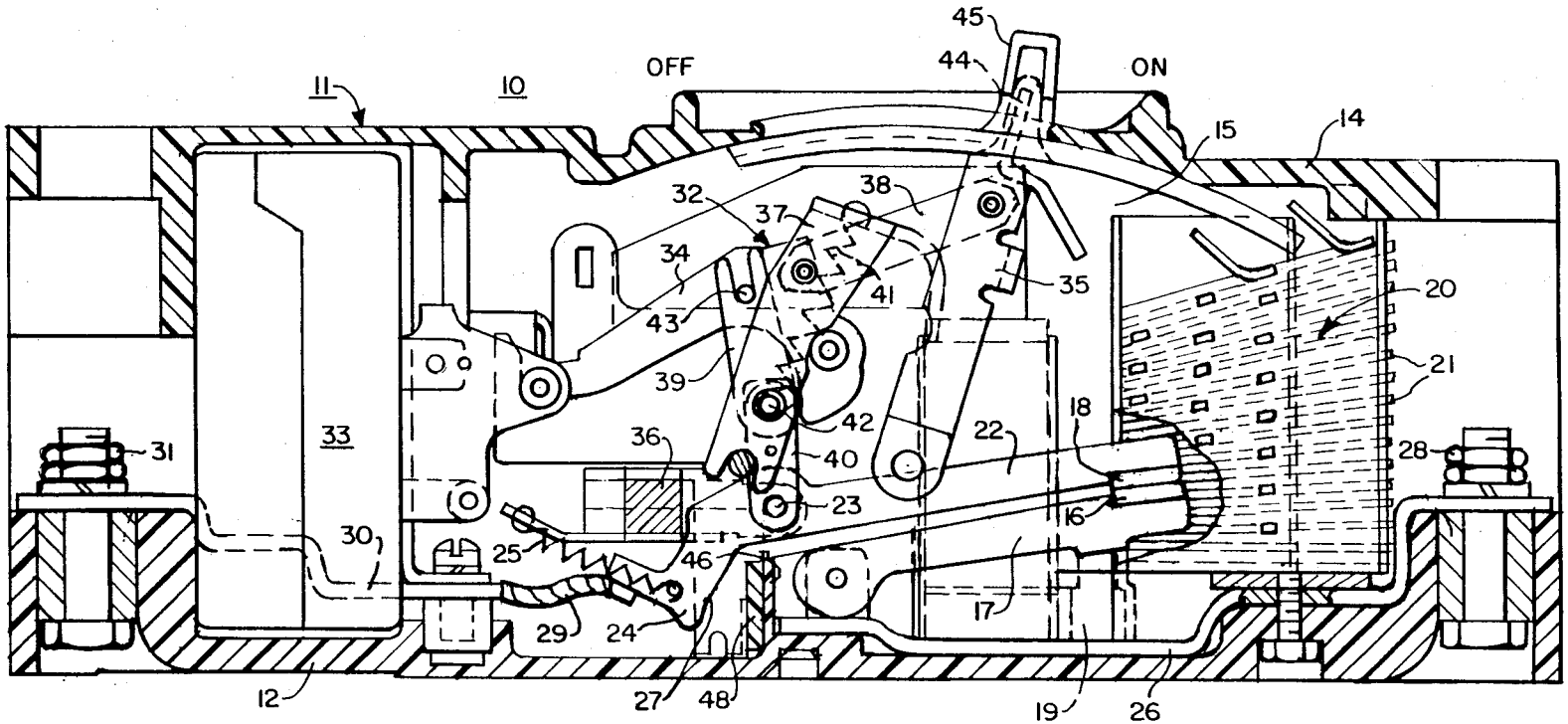
FIG. 1 is a sectional view through the center pole portion of a three-pole molded case circuit breaker of the low-voltage type which incorporates the improved movable contact arm and resilient stop assembly of the present invention.

In FIG. 1 there is shown a molded case three-pole circuit breaker 10 which comprises an insulating housing 11 that is fabricated from a suitable plastic and includes a base component 12 and a removable cover component 14. Insulating barrier means 15 within the housing 11 defines, in conjunction with the base 12 and cover 14, three adjacent compartments that contain the three-pole units. One of the pole units is shown in FIG. 1 and consists of the usual stationary contact 16 and a movable contact 18 that are located (when in their closed position as shown) within the confines of an arc chute assembly 20 which defines an arc extinguishing chamber. The arc chute assembly 20 comprises the usual series of arc chute plates 21 that are held in vertically stacked position and are adapted to divide the arc into small segments and rapidly extinguish it when the contacts 16, 18 are suddenly opened. The stationary contact 16 is mounted on an arm 17 that is pivotally secured to the housing 11 at one end and is resiliently supported in generally horizontal fixed position at the bottom of the breaker 10 by a suitable spring (not shown) located in a suitable recess formed by the underlying part 19 of the housing structure. The movable contact 18 is secured to one end of an elongated movable contact arm 22 that is pivotally coupled at 23 to a suitable upstanding support that comprises an integral part of the molded plastic base 12. In accordance with the invention, the end of the movable contact arm 22 opposite the movable contact 18 is laterally offset and comprises a crank-shaped striker portion 24. A spring 25 secured to the striker portion applies a bias to the movable contact arm 22 that presses the closed contacts 16, 18 against one another.

Since the present invention resides in the provision of an improved resilient stop assembly for arresting the motion of the movable contact arm 22 and movable contact 18 when the circuit breaker 10 is tripped, only a generalized description of the structural and operational features of the breaker is required and will be given.

In accordance with the usual practice in the circuit breaker art, the stationary contact 16 is connected by its contact arm 17 and a suitable conductor 26 to a terminal such as a connecting fastener 28 which is located within and extends through a boss located on an exterior part of the base 12. The movable contact 18 is similarly connected by its contact arm 22 and a flexible conductor 29 which is fastened to the striker end portion 24 of the arm and then to a suitable rigid conductor 30 that is anchored to the base 12 by another fastener 31 mounted within a second boss located at the opposite end of the circuit breaker housing 11. An operating mechanism 32 (which is common to and operates each of the three pole units) is provided for simultaneously actuating the three movable contacts in each of the three breaker compartments between their open and closed positions. A suitable trip device, indicated generally at 33, automatically releases the cradle 34 of the operating mechanism 32 and opens the breaker contacts 16, 18 in response to circuit-overload conditions in a manner well known to those skilled in the art. A tie bar 36 fastened to the movable contact arm 22 is suitably supported in the housing 11 for movement about an axis between "contact-open" and "contact-closed" positions. The operating mechanism 32 is located in the center compartment of the breaker housing 11 and is supported on a pair of spaced frame members that extend upwardly from the base 12. The operating mechanism 32 comprises a generally U-shaped operating lever 35, a toggle assembly consisting of toggle links 37, 38, 39 and 40, a pair of overcenter springs 41 and the releasable cradle or trip member 34 that is controlled by the trip device 33.

The toggle links 39, 40 are pivotally connected together by a knee pivot 42 and the upper end of the link 39 is pivotally connected to the trip member 34 by a pin 43. The lower end of the toggle link 40 is pivotally connected to the movable contact arm 22 by the pivot pin 23. The end 44 of the operating lever 35 is coupled to an insulating handle 45 which is movably mounted on the cover 14 and is shiftable between "ON" and "OFF" positions. After the circuit breaker 10 has been tripped, it is manually closed by first moving the handle 45 in a counterclockwise direction to relatch the cradle 34 with the trip mechanism 33 and then shifting the handle 45 in a clockwise direction to the "ON" position which causes the toggle components of the operating mechanism 32 to depress the movable contact arms 22 of each of the pole units into their "contact-closed" position shown in FIG. 1.

In accordance with the present invention, the molded plastic base 12 of the circuit breaker housing 11 is provided with an upstanding appendage or shoulder such as a panel 46 that is formed as an integral part of the base 12 and is located adjacent but spaced a predetermined distance from the striker end portion 24 of the movable contact arm when the circuit breaker 10 is in its "contact-closed" condition, as shown in FIG. 1. The face of the shoulder panel 46 is covered with a layer 48 of suitable resilient material (such as a hard rubber composition) which, together with the shoulder 46, constitutes a resilient stop for arresting the motion of the movable contact arm 22 during the contact-opening stroke of the circuit breaker 10 when the contacts 16, 18 are blown open under short-circuit conditions. The striker end portion 24 of the contact arm 22 is provided with a substantially flat face 27 which is swung toward and hits the pad 48 and shoulder panel 46 at a predetermined time after the movable contact 18 has separated from the fixed contact 16 and the contact arm 22 has swung a predetermined distance along its arcuate path toward the cover 14 of the housing 11. As will be noted in FIG. 2, the striker face 27 is in substantially parallel relationship with the pad 48 and stop panel 46 when the contacts 16, 18 are in their blown-open position.

Figure 2:
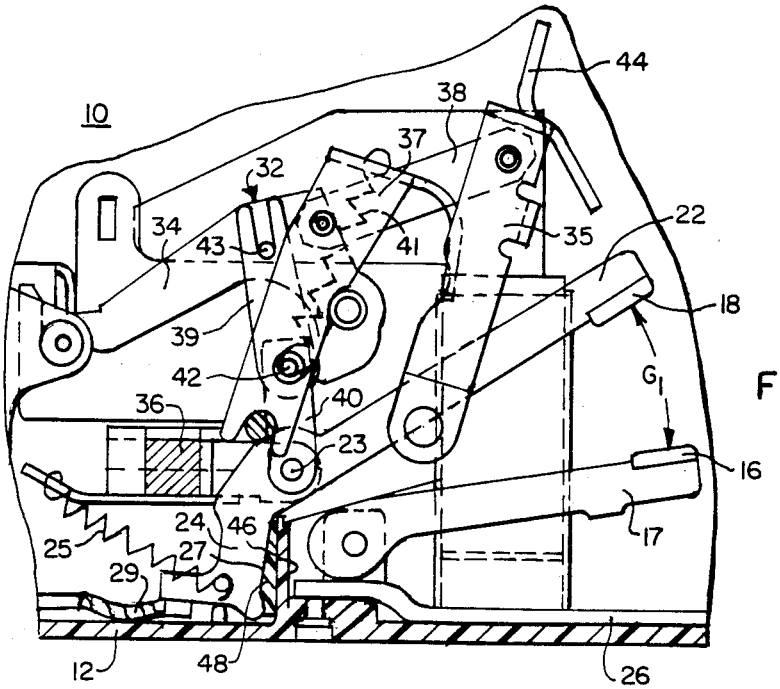
FIGS. 2 and 3 are side elevational views of the toggle and contact portions of the circuit breaker shown in FIG. 1 with the movable contact arm and associated operating parts of the toggle assembly in their "blow open" and tripped positions, respectively.

As also shown in FIG. 2, as the movable contact arm 22 and its contact 18 are being swung into their blown-open positions, the striker end portion 24 of the arm automatically swings in the opposite direction until the striker face 27 hits and compresses the resilient pad 48 on the stop panel 46 after the contact arm 22 has traveled a distance which provides a contact gap $G_1$. This is the same gap distance achieved in the prior art circuit breakers having the conventional rubber stop elements that are secured to the cover (or handle) of the circuit breaker.

Figure 3:
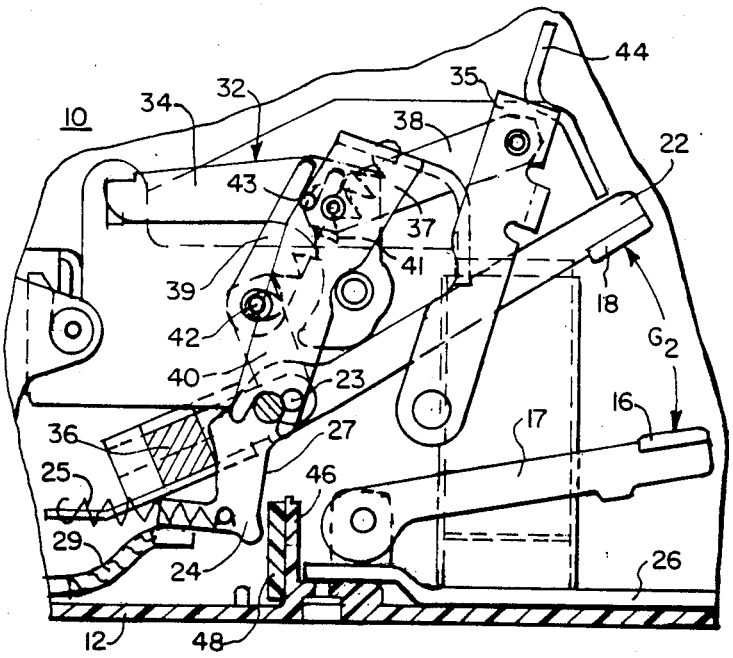

However, as illustrated in FIG. 3, the present invention permits the movable contact arm 22 and its contact 18 to swing an additional distance away from the fixed contact 16 after the circuit breaker 10 has been tripped and the toggle assembly of the operating mechanism 32 has collapsed and shifted the contact arm 22 and its striker end portion 24 upwardly and away from the stop means provided by the upstanding rigid stop panel 46 and resilient pad 48. This upward additional travel of the movable arm 22 and contact 18 (which would have been impossible in the prior art circuit breakers having a resilient stop located on the housing cover or circuit breaker handle) provides a wider open-contact gap $G_2$. Tests have indicated that a 21% increase in the contact gap of the tripped breaker 10 is realized by utilizing the improved resilient stop structure of the present invention that is located at the bottom of the circuit breaker housing 11 rather than on the cover 14 or handle assembly of the circuit breaker as in the prior art.

Since the resilient pad 48 need only supply sufficient cushioning action to prevent the striker end portion 24 of the metal contact arm 22 from cracking or damaging the rigid stop panel 46 of the plastic base 12, the pad can be relatively thin (as shown)—thus reducing the material cost of the breaker 10. The permanent tooling for manufacturing the circuit breaker handle is also simplified and reduced in cost compared to the prior art breaker designs which incorporated the rubber stop elements in the breaker handles.

Figure 4:
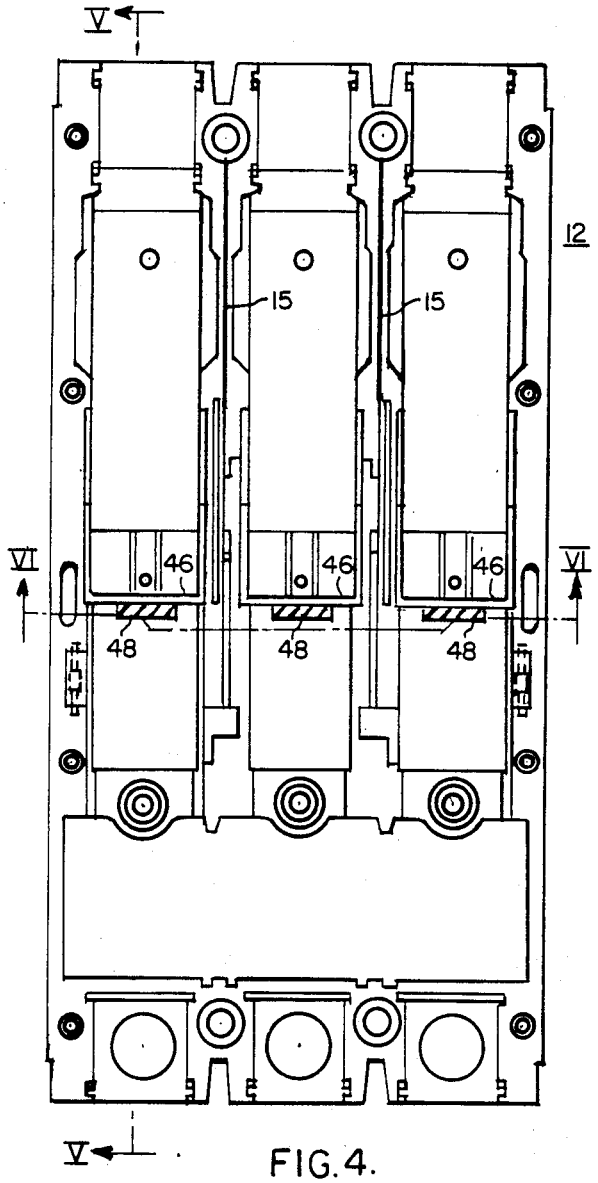
FIG. 4 is a top plan view, on a reduced scale, of the molded plastic component of the breaker housing illustrating the location of the integral stop structures within each of the three compartments provided by the base component.
Figure 5:
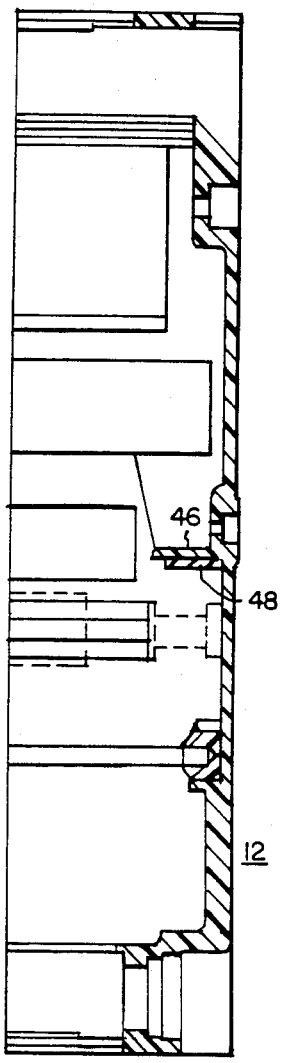
FIGS. 5 and 6 are sectional views through the base component of the circuit breaker housing along lines V—V and VI—VI of FIG. 4, respectively.
Figure 6:
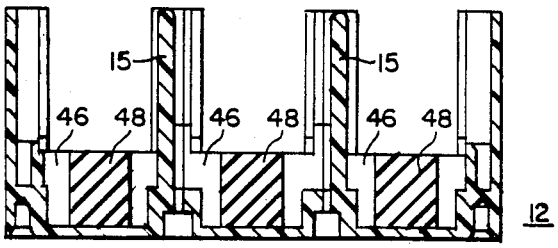

As will be noted in the top plan view of the molded plastic base component 12 of the circuit breaker 10 shown in FIG. 4, each of the three compartments provided by the barriers 15 in base 12 include an integral resilient stop structure formed by the upstanding rigid shoulder panels 46 and attached pads 48 of rubber or other suitable material. As shown more particularly in FIGS. 5 and 6, the panels 46 are molded as integral parts of the plastic base 12 and the pads 48 consist of relatively thin layers of suitable resilient material that cover only the central portions of each of the panels 46 that are aligned with and will be struck by the striker end portions 24 of the respective movable contact arms 22. This provides individual resilient stop structures for each of the movable contact arms 22 of the three-pole circuit breaker 10 which are not only rugged and durable but materially reduce the manufacturing cost of the breaker.

We claim:

1. A circuit interrupter comprising;

a housing comprising a base component and a cover component of insulating material, said base component having a wall portion with rigid shoulder means that protrudes into the interior of said housing, a pair of separable contacts disposed within said housing, one of said contacts being secured to the end portion of an elongated contact arm that is pivoted at a medial part thereof and is swingable toward and away from the other contact along an arcuate path such that the contacts engage and then separate from one another, an operating mechanism supported within said housing and adapted to move the swingable contact arm and thus open and close said contacts when the operating mechanism is sequentially actuated, and means for arresting the movement of said swingable contact arm at a predetermined time during the contact-opening stroke of the circuit interrupter comprising a cushioning component of resilient material that is secured to the shoulder means of said wall portion and together therewith constitutes a resilient stop for said contact arm, the end portion of said contact arm which is remote from the contact on said arm being located proximate said resilient stop and being so oriented that it swings toward the cushioning component of the stop as the contacts are being separated and then strikes said resilient stop when the contacts are spaced a predetermined distance apart.

2. The circuit interrupter of claim 1 wherein said base component has a bottom wall portion and said rigid shoulder means is integral with and protrudes upwardly from the bottom wall portion of said base component.

3. The circuit interrupter of claim 1 wherein;

said housing is fabricated from molded plastic material, said rigid shoulder means comprises an upstanding panel member that is an integral part of the base component of the molded plastic housing, and the cushioning component comprises a rubber pad that is secured to the face of the panel member that is disposed toward the proximate end portion of said pivoted contact arm.

4. The circuit interrupter of claim 1 wherein;

the operating mechanism includes a toggle assembly that is coupled to the movable contact arm, and said toggle assembly is adapted to collapse and permit the movable contact arm to swing further away from the other contact, when the circuit interrupter is tripped, and thereby increase the gap distance between said contacts.

5. The circuit interrupter of claim 4 wherein the toggle assembly, when collapsed, causes a shift in the position of the movable contact arm such that the striker end portion of said arm is displaced from seated engagement with said resilient stop.

6. The circuit interrupter of claim 2 wherein;

said housing is divided by barrier structures into three compartments each of which contains a pair of separable contacts and a medially-pivoted swingable contact arm, and the bottom wall portion of said base component has three upwardly protruding rigid shoulder means and associated cushioning components that serve as individual resilient stop means for the pivoted contact arms disposed in the respective compartments.

7. The circuit interrupter of claim 6 wherein;

the base and cover components of said housing are fabricated from molded plastic material, and said rigid shoulder means comprises upstanding panel members that constitute integral parts of the bottom wall portion of the molded plastic base component.

8. The circuit interrupter of claim 3 wherein the end portion of the contact arm that strikes the rubber pad and panel member is of crank-like configuration and has a substantially flat striker face that is disposed in substantially parallel relationship with said rubber pad when the crank-like end portion of the contact arm is swung into pressurized engagement with the rubber pad and panel member of the housing during the contact-opening stroke of the circuit interrupter.

* * * * *